US010155376B1

(12) United States Patent
Ireland

(10) Patent No.: US 10,155,376 B1
(45) Date of Patent: Dec. 18, 2018

(54) SYSTEM AND APPARATUS FOR EVALUATING INKJET PERFORMANCE AND ALIGNMENT IN A DIRECT-TO-OBJECT PRINTER

(71) Applicant: Xerox Corporation, Norwalk, CT (US)

(72) Inventor: Jonathan R. Ireland, Lancaster, PA (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 15/841,934

(22) Filed: Dec. 14, 2017

(51) Int. Cl.
*B41J 3/407* (2006.01)
*B41F 17/34* (2006.01)

(52) U.S. Cl.
CPC ..... *B41F 17/34* (2013.01); *B41J 3/4073* (2013.01)

(58) Field of Classification Search
CPC ..... B41J 3/4073; B41J 3/407; B41F 17/30; B41F 17/00; B41F 17/006; B41F 17/34; B41M 5/0088; B41M 5/0047
See application file for complete search history.

(56) References Cited

U.S. PATENT DOCUMENTS 6,238,039 B1 5/2001 Balakrishnan et al.
6,513,435 B2 * 2/2003 Detzner ..... C03C 17/245 101/35
6,923,115 B1 8/2005 Litscher et al.
7,765,931 B2 8/2010 Kennedy, III et al.
8,511,782 B2 8/2013 Chang et al.
9,114,282 B2 8/2015 Kennedy, III
9,120,300 B2 9/2015 Moehringer et al.
9,217,090 B2 12/2015 Donohoe et al.
9,925,726 B1 * 3/2018 Bradway ..... B29C 67/0096
9,975,327 B1 * 5/2018 Yang ..... B41J 11/002
10,005,292 B1 * 6/2018 Williams ..... B41J 3/4073
10,005,302 B1 * 6/2018 Vanbortel ..... B41J 3/4073
2002/0097280 A1 7/2002 Loper et al.
2002/0134257 A1 9/2002 Stephenson
2002/0191036 A1 12/2002 Park
2005/0178279 A1 8/2005 Valls
2005/0179721 A1 8/2005 Jones et al.
2009/0256897 A1 10/2009 Polk et al.
2011/0012952 A1 1/2011 Chang et al.
2015/0158310 A1 6/2015 Olejniczak et al.
2015/0224765 A1 8/2015 Fukasawa
2015/0273864 A1 10/2015 Moehringer et al.
2017/0282594 A1 * 10/2017 Akao ..... B41J 3/4073

* cited by examiner

*Primary Examiner* — Huan Tran
(74) *Attorney, Agent, or Firm* — Maginot Moore & Beck LLP

(57) ABSTRACT

An apparatus enables the effect of distance changes between ejectors in printheads of a printing system and the surface receiving ejected drops to be evaluated. The apparatus includes a housing with a cavity having a sloping floor to which a substrate is mounted to receive drops ejected by printheads in the printing system. The floor of the cavity can slope in either the process or cross-process direction. The substrate can include fiducial marks and target lines to enhance the analysis of the effect of changing distance on the ejected drops.

18 Claims, 8 Drawing Sheets

SYSTEM AND APPARATUS FOR EVALUATING INKJET PERFORMANCE AND ALIGNMENT IN A DIRECT-TO-OBJECT PRINTER

TECHNICAL FIELD

This disclosure relates generally to a system for printing on three-dimensional (3D) objects, and more particularly, to systems for evaluating the effect of varying flight distances for ejected drops in such printers.

BACKGROUND

Commercial article printing typically occurs during the production of the article. For example, ball skins are printed with patterns or logos prior to the ball being completed and inflated. Consequently, a non-production establishment, such as a distribution site or retail store, for example, in a region in which potential product customers support multiple professional or collegiate teams, needs to keep an inventory of products bearing the logos of various teams popular in the area. Ordering the correct number of products for each different logo to maintain the inventory can be problematic.

One way to address these issues in non-production outlets is to keep unprinted versions of the products, and print the patterns or logos on them at the distribution site or retail store. Printers known as direct-to-object (DTO) printers have been developed for printing individual objects. These DTO printers have a plurality of printheads that are typically arranged in a vertical configuration with one printhead over another printhead. These printheads are fixed in orientation. When the objects to be printed are ovoid or shapes having multiple indentations and protrusions, such as balls, water bottles, and the like, printing a complete image on the surface accurately is difficult because portions of the surface of object fall away from the planar face of the printheads. Multiple alignment issues between printheads arise because the ejectors in the printheads eject the marking material across gaps of various distances. The movement of the objects past the printheads taken in conjunction with the various gap distances also affects the coordination of the timing of the signals used to operate the ejectors in the printheads. These issues include the droop in the drops as they cross the gaps, the orientation of the ejectors in the printheads, and the like. For example, the drops from an ejector that is not truly oriented perpendicularly to an object stray further from the intended flight path as the imaging distance increases. Identifying and measuring these effects so the data used to operate the printheads during printing could be modified to compensate for these effects would be beneficial.

SUMMARY

An apparatus has been configured to enable a printing system to identify and measure the effects of gap distances on the characteristics of the printhead. The apparatus includes a housing having a cavity with a sloping floor to enclose a triangular volumetric space within the cavity and the housing has a planar surface that surrounds the cavity, and a substrate attached to the planar surface adjacent the cavity and to the sloping floor within the cavity to enable a printhead that extends across a plane parallel to the planar surface of the housing in a cross-process direction to eject drops of material onto the substrate for evaluation of an effect of a changing distance between ejectors in the printhead and the substrate.

A new printing system is configured with an apparatus that enables the printing system to identify and measure the effects of gap distances on the characteristics of the printhead. The printing system includes a plurality of printheads arranged in a two-dimensional array, each printhead being configured to eject marking material, a support member positioned to be parallel to a plane formed by the two-dimensional array of printheads, a member movably mounted to the support member, an actuator operatively connected to the movably mounted member to enable the actuator to move the moveably mounted member along the support member, an apparatus configured to mount to the movably mounted member to enable the object holder to pass the array of printheads as the moveably mounted member moves along the support member. The apparatus includes a housing having a cavity with a sloping floor to enclose a triangular volumetric space within the cavity and the housing has a planar surface that surrounds the cavity, and a substrate attached to the planar surface adjacent the cavity and to the sloping floor within the cavity to enable a printhead that extends across a plane parallel to the planar surface of the housing in a cross-process direction to eject drops of material onto the substrate for evaluation of an effect of a changing distance between ejectors in the printhead and the substrate. The printing system also includes a controller operatively connected to the plurality of printheads and the actuator, the controller being configured to operate the actuator to move the apparatus past the array of printheads and to operate the plurality of printheads to eject marking material onto the apparatus as the apparatus passes the array of printheads.

BRIEF DESCRIPTION OF THE DRAWINGS

The foregoing aspects and other features of an apparatus that enables a printing system to identify and measure the effects of gap distances on drops ejected by a printhead in the system are explained in the following description taken in connection with the accompanying drawings.

DETAILED DESCRIPTION

Figure 1:
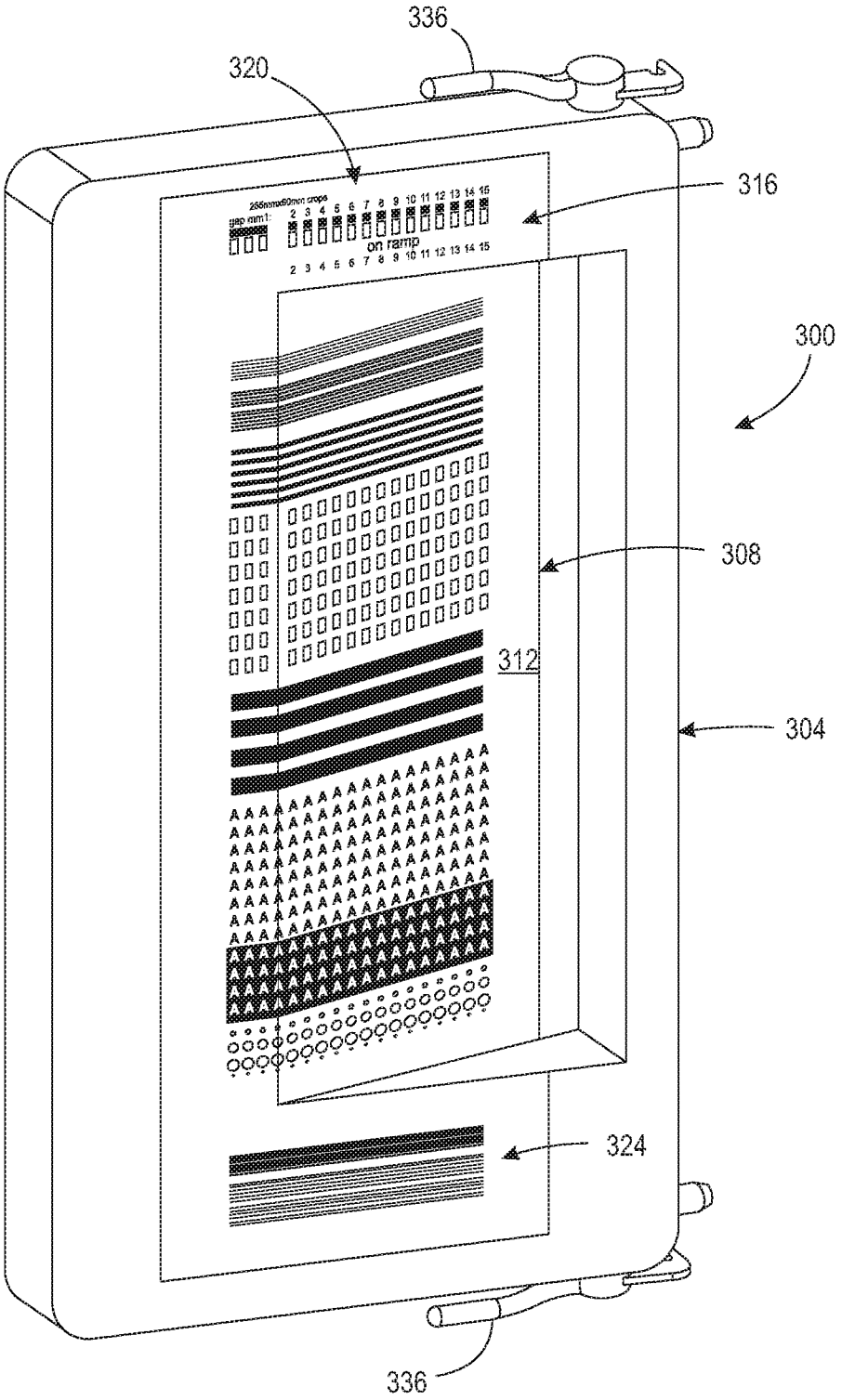
FIG. 1 depicts an embodiment of an apparatus useful for identifying and measuring the effects of gap distances on drops ejected by a printhead in a printing system.

For a general understanding of the present embodiments, reference is made to the drawings. In the drawings, like reference numerals have been used throughout to designate like elements.

Figure 4:
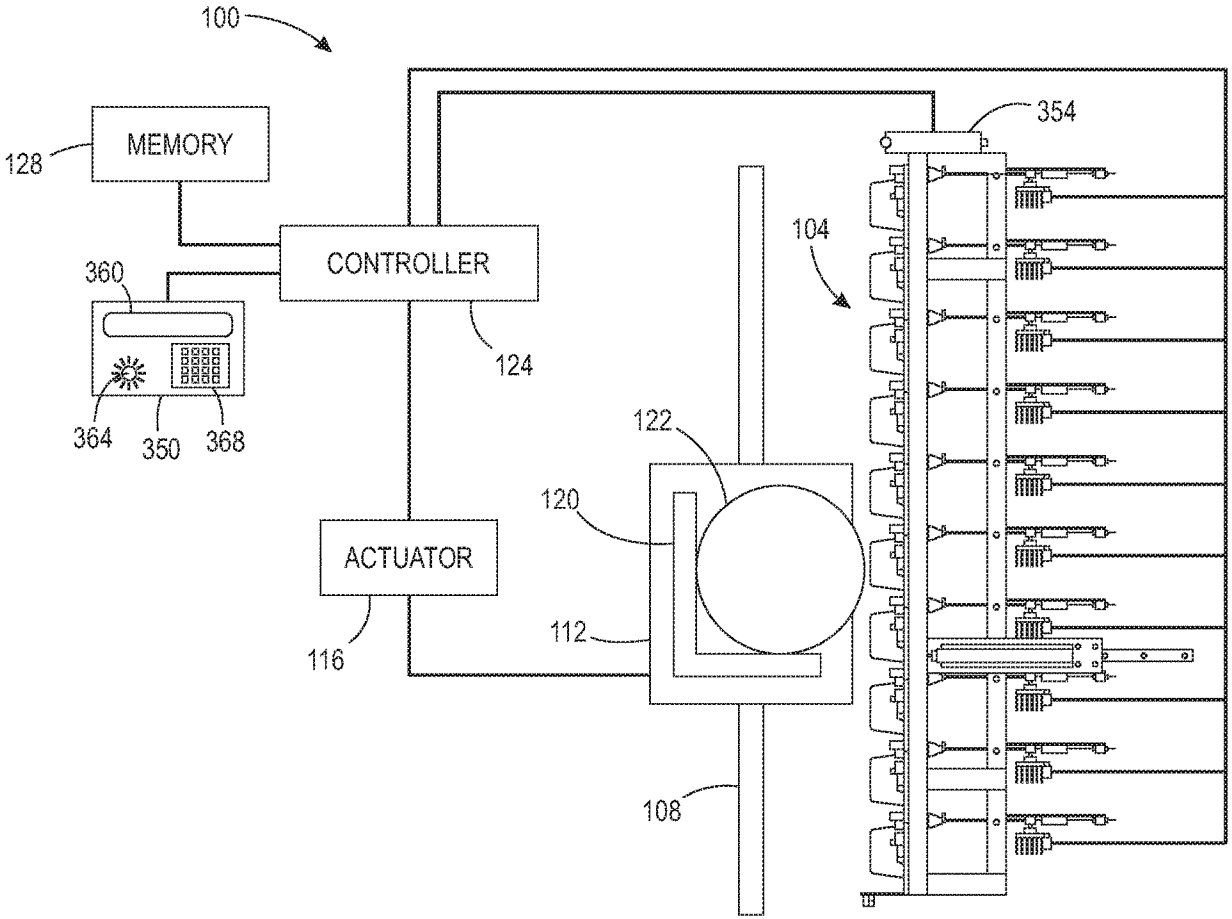
FIG. 4 PRIOR ART
FIG. 4 illustrates a prior art printing system 100 configured to print an image on a 3D object.

FIG. 4 illustrates an exemplary printing system 100 configured to print on a 3D object. The term "direct-to-object" (DTO) printer is used to describe such a printer in this document. The printing system 100 includes an array of printheads 104, a support member 108, a member 112 movably mounted to the support member 108, an actuator 116 operatively connected to the movably mounted member 112, an object holder 120 configured to mount to the movably mounted member 112, and a controller 124 operatively connected to the plurality of printheads and the actuator. As shown in FIG. 4, the array of printheads 104 is arranged in a two-dimensional array, which in the figure is a 10×1 array, although other array configurations can be used. Each printhead is fluidly connected to a supply of marking material (not shown) and is configured to eject marking material received from the supply. Some of the printheads can be connected to the same supply or each printhead can be connected to its own supply so each printhead can eject a different marking material. The controller 124 is also operatively connected to a user interface 350, a memory 128, and an optical sensor 354.

The support member 108 is positioned to be parallel to a plane formed by the array of printheads and, as shown in the figure, is oriented so one end of the support member 108 is at a higher gravitational potential than the other end of the support member. This orientation enables the printing system 100 to have a smaller footprint than an alternative embodiment that horizontally orients the array of printheads and configures the support member, movably mounted member, and object holder to enable the object holder to pass objects past the horizontally arranged printheads so the printheads can eject marking material downwardly on the objects.

The member 112 is movably mounted to the support member 108 to enable the member to slide along the support member. In some embodiments, the member 112 can move bi-directionally along the support member. In other embodiments, the support member 108 is configured to provide a return path to the lower end of the support member to form a track for the movably mounted member. The actuator 116 is operatively connected to the movably mounted member 112 so the actuator 116 can move the moveably mounted member 112 along the support member 108 and enable the object holder 120 connected to the moveably mounted member 112 to pass the array of printheads 104 in one dimension of the two-dimensional array of printheads. In the embodiment depicted in the figure, the object holder 120 moves an object 122 along the length dimension of the array of printheads 104.

The controller 124 is configured with programmed instructions stored in the memory 128 operatively connected to the controller so the controller can execute the programmed instructions to operate components in the printing system 100. Thus, the controller 124 is configured to operate the actuator 116 to move the object holder 120 past the array of printheads 104 and to operate the array of printheads 104 to eject marking material onto objects held by the object holder 120 as the object holder passes the array of printheads 104. Additionally, the controller 124 is configured to operate the inkjets within the printheads of the array of printheads 104 so they eject drops with larger masses than the masses of drops ejected from such printheads. In one embodiment, the controller 124 operates the inkjets in the printheads of the array of printheads 104 with firing signal waveforms that enable the inkjets to eject drops that produce drops on the object surfaces having a diameter of about seven to about ten mm. This drop size is appreciably larger than the drops typically ejected onto a material receiving surface having a mass of about 21 ng.

The system configuration shown in FIG. 4 is especially advantageous in a number of aspects. For one, as noted above, the vertical configuration of the array of printheads 104 and the support member 108 enables the system 100 to have a smaller footprint than a system configured with a horizontal orientation of the array and support member. This smaller footprint of the system enables the system 100 to be housed in a single cabinet 180, as depicted in FIG. 5C, and installed in non-production outlets. Once installed, various object holders, as described further below, can be used with the system to print a variety of goods that are generic in appearance until printed. Another advantageous aspect of the system 100 shown in FIG. 4 is the gap presented between the plane tangential to the face of a round object, such as the one shown in FIG. 4, carried by the object holder 120 and the printheads of the array 104. The gap in this embodiment is in a range of about five to about six mm. Heretofore, the gap was maintained in a range centered about 1 mm. This smaller gap was thought to ensure a more accurate placement of drops from an ejecting printhead. The greater gap width reduces the effect of laminar air flow in the gap between the printheads and the surface receiving the marking material drops so the accuracy of drop placement, especially for larger 3D objects, is maintained. This effect is particularly effective with the larger drop sizes noted previously. Without the turbulence produced by the movement of an object in close proximity to a printhead, the momentum of the ejected drops is adequate to keep the drops on their projected course so the registration of the drops from different printheads can be preserved for maintaining image quality. Still, the difference in the distance between the face of the printheads and the drop receiving surface of the object can affect the flight path of the drops. Additionally, the controller 124 can be configured with programmed instructions to operate the actuator 116 to move the object holder at speeds that attenuate the air turbulence in the larger gap between the printhead and the object surface used in the system 100.

Figure 5A:
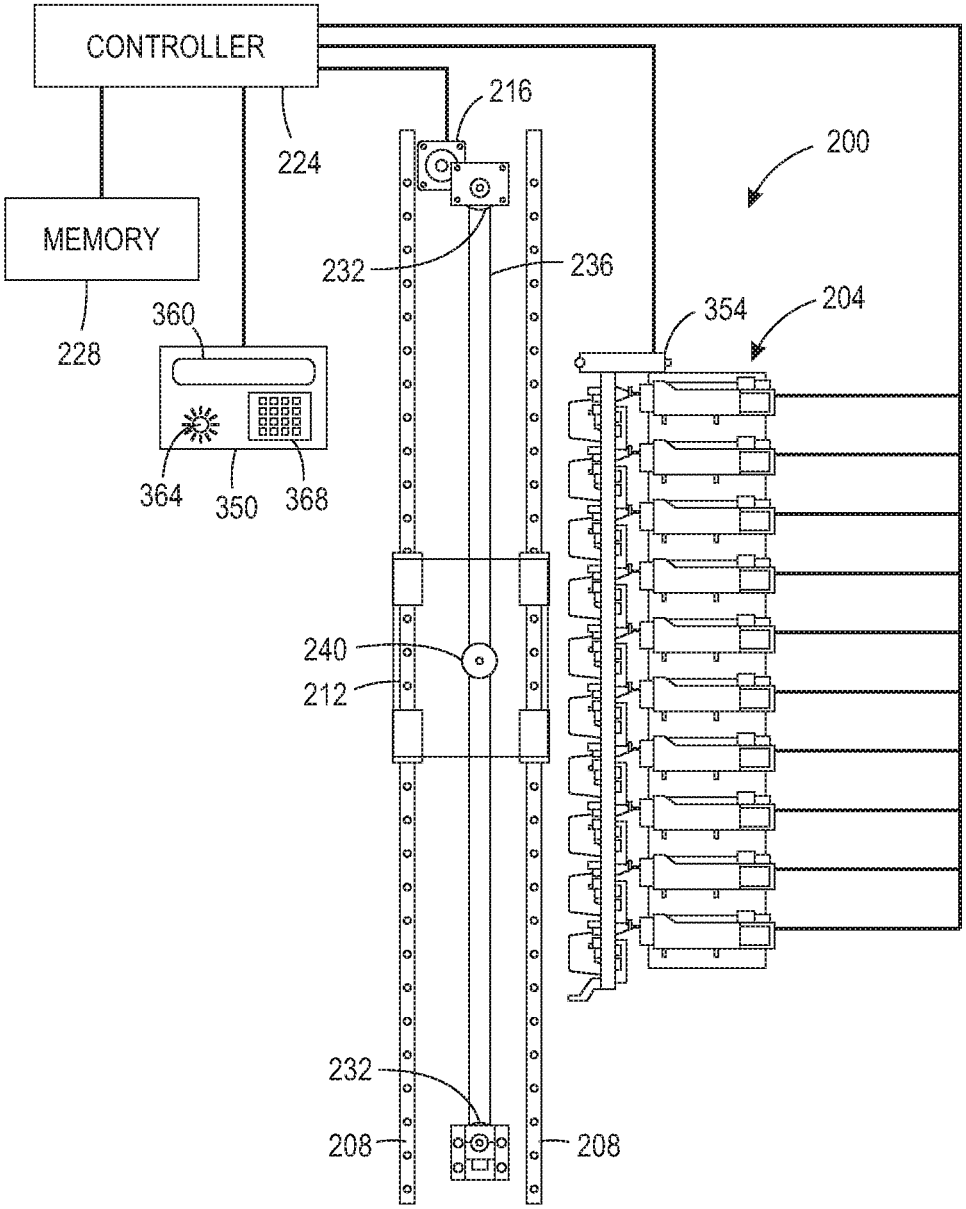
FIG. 5A PRIOR ART
FIG. 5A and FIG. 5B are other prior art embodiments of the system 100 that use a double support member to enable movement of objects past an array of printheads.

An alternative embodiment of the system 100 is shown in FIG. 5A. In this alternative embodiment 200, the support member is a pair of support members 208 about which the moveably mounted member 212 is mounted. This embodiment includes a pair of fixedly positioned pulleys 232 and a belt 236 entrained about the pair of pulleys to form an endless belt. The moveably mounted member 212 includes a third pulley 240 that engages the endless belt to enable the third pulley 240 to rotate in response to the movement of the endless belt moving about the pair of pulleys 232 to move the moveably mounted member 212 and an object holder (not shown) mounted to it. In this embodiment, the actuator 216 is operatively connected to one of the pulleys 232 so the controller 224 can operate the actuator to rotate the driven pulley and move the endless belt about the pulleys 232. The controller 224 can be configured with programmed instructions stored in the memory 228 to operate the actuator 216 bi-directionally to rotate one of the pulleys 232 bi-directionally for bi-directional movement of the moveably mounted member 212 and the object holder past the array of printheads 204. In another alternative embodiment shown in FIG. 5B, one end of the belt 236 is operatively connected to a take-up reel 244 that is operatively connected to the actuator 216. The other end of the belt 236 is fixedly positioned. The controller 224 is configured with programmed instructions stored in the memory 228 to enable the controller 224 to operate the actuator 216 to rotate the take-up reel 244 and wind a portion of the length of the belt about the take-up reel 244. The belt 244 also engages a rotatable pulley 248 mounted to the moveably mounted member 212. Since the other end of the belt 236 is fixedly positioned, the rotation of the reel 244 causes the moveably mounted member 212 to move the object holder mounted to the member past the array of printheads. When the controller 224 operates the actuator 216 to unwind the belt from the reel 224, the moveably mounted member 212 descends and enables the object holder to descend past the array of printheads 204. This direction of movement is opposite to the direction in which the object holder moved when the actuator was operated to take up a length of the belt 236. These configurations using a belt to move the moveably mounted member differ from the one shown in FIG. 4 in which the controller 124 operates a linear actuator to move the moveably mounted member 112 and the object holder 120 bi-directionally past the array of printheads.

An example of a device 300 useful for identifying the effects of varying distance on the flight paths of ejected drops from printheads in a DTO printer, for example, is shown in FIG. 1. The device 300 has a housing 304 with a cavity 308 that has a sloping floor 312. The sloping floor 312 of the cavity 308 forms a triangular volumetric space within the housing 304. Because the width of the printhead array is the width of a single printhead, the dimensions of the housing for use in one of the printers shown in FIG. 4 and FIG. 5A to FIG. 5C is the largest area that a single printhead can print plus the area to accommodate the fiducial marks and the adhesive or tape used to secure the substrate 316 to the housing. If a DTO printer had a printhead array width corresponding to multiple printheads arranged in a row, then the size of the housing is adjusted to accommodate that different width with the additional area required for the fiducial marks and the like. The floor slopes at any appropriate linear angle from the position where the housing floor 312 is flush with the surface surrounding the cavity 308 to a position where the floor is flush with the bottom of the cavity. The embodiment of device 300 can also be configured so the floor 312 slopes in the opposite direction. That is, the floor 312 slopes downwardly from the planar surface of the housing 304 between the latches 336 and the cavity edge closest to the latches to the bottom of the cavity, which would be adjacent to the cavity edge most distal from the latches. This slope is the opposite of the slope of the floor of the cavity in the cross-process direction that is shown in FIG. 1.

Mounted to the surface of the device 300 is a substrate 316. Substrate 316 is attached to the planar surface of the housing 304 that is adjacent the cavity 308 and to the sloping floor 312 to enable a printhead that extends across the shorter dimension of the cavity 308 in a plane parallel to the planar surface of the housing 304 that surrounds the cavity 308 to eject drops of material onto the substrate for evaluation of an effect of a changing distance between ejectors in the printhead and the substrate. The substrate 316 is configured with fiducial marks 320 and target lines 324. As used in this document, the term "fiducial mark" and "target line" refers to any indicia useful for providing a reference point to analyze a test pattern printed on the substrate. The area of the substrate 316 between fiducial marks 320 and target lines 324 is left blank so the printheads can be operated to eject marking material in this area for comparison to the fiducial marks 320 and the target lines 324. The comparison of the printed lines to the fiducial marks 320 and the target lines 324 enables the deviations of the printed lines from these marks and lines to be measured to identify the effects of the varying distance between the sloping floor 312 and the ejectors in the printheads that formed the lines on the flight paths of the ejected drops. In one embodiment, the fiducial marks 320 are spaced 1 mm apart on a line parallel with the slope of the sloping floor 312 to identify the gap distance between the ejectors and the substrate at that location. The target lines 324 identify the lines that would be printed if the gap distance remained at the distance closest to the printheads, which is the distance of the planar surface of the housing 304 from the face of the printheads in the array 104.

Figure 2:
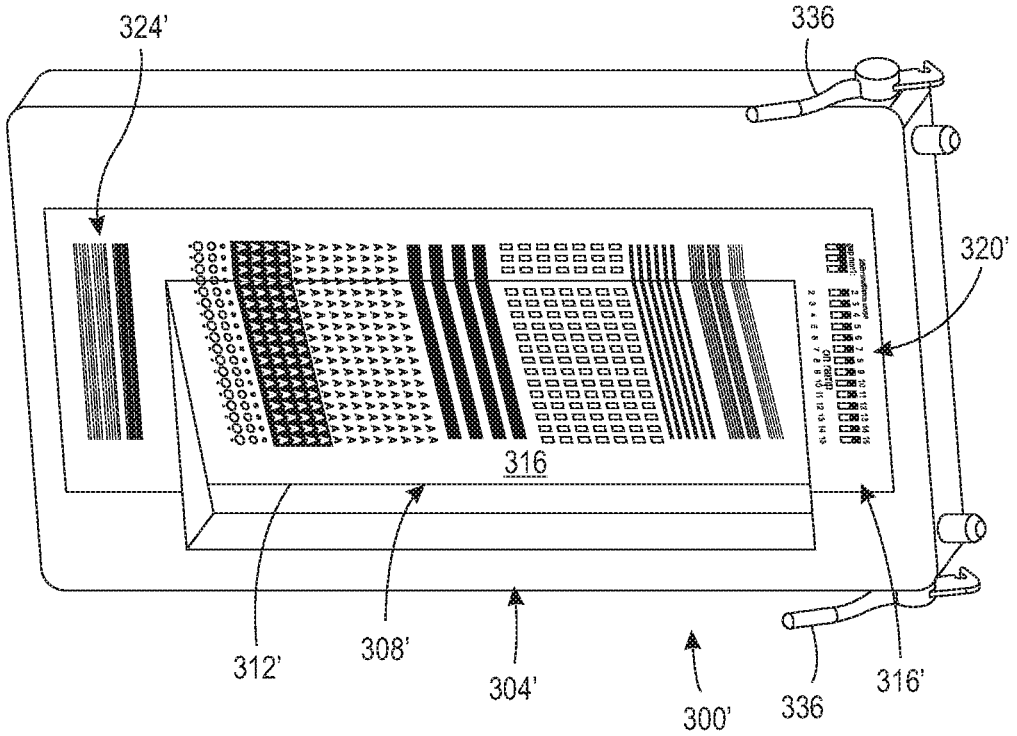
FIG. 2 depicts a different embodiment of the apparatus shown in FIG. 1 that is useful for identifying and measuring the effects of gap distances on drops ejected by a printhead in a printing system.

Another embodiment of device 300' that is useful for identifying a different set of effects of varying distances on the flight paths of drops from printheads in a DTO printer, for example, is shown in FIG. 2. The device 300' has a housing 304' with a cavity 308' that has a sloping floor 312'. The sloping floor 312' of the cavity 308' forms a triangular volumetric space within the housing 304'. Because the width of the printhead array is the width of a single printhead, the dimensions of the housing for use in one of the printers shown in FIG. 4 and FIG. 5A to FIG. 5C is the largest area that a single printhead can print plus the area to accommodate the fiducial marks and the adhesive or tape used to secure the substrate 316' to the housing. If a DTO printer had a printhead array width corresponding to multiple printheads arranged in a row, then the size of the housing is adjusted to accommodate that different width with the additional area required for the fiducial marks and the like. The floor slopes at any appropriate linear angle from the position where the housing floor 312' is flush with the surface surrounding the cavity 308' to a position where the floor is flush with the bottom of the cavity. The embodiment of device 300' can also be configured so the floor 312' slopes in the opposite direction. That is, the floor 312' slopes downwardly from the lower boundary of the cavity to the upper boundary of the cavity, rather than downwardly from upper boundary of the cavity to the lower boundary of the cavity as shown in FIG. 1.

Mounted to the surface of the device 300' is a substrate 316'. Substrate 316' is attached to the planar surface of the housing 304' that is adjacent the cavity 308' and to the sloping floor 312' to enable a printhead that extends across the longer dimension of the cavity 308' in a plane parallel to the planar surface of the housing 304' that surrounds the cavity 308' to eject drops of material onto the substrate for evaluation of an effect of a changing distance between ejectors in the printhead and the substrate. The substrate 316' is configured with fiducial marks 320' and target lines 324'. The area of the substrate 316' between fiducial marks 320' and target lines 324' is left blank so the printheads can be operated to eject marking material in this area for comparison to the fiducial marks 320' and the target lines 324'. The comparison of the printed lines to the fiducial marks 320' and the target lines 324' enables the deviations of the printed lines from these marks and lines to be measured to identify the effects of the varying distance between the sloping floor 312' and the ejectors in the printheads that formed the lines on the flight paths of the ejected drops. In one embodiment, the fiducial marks 320' are spaced 1 mm apart on a line parallel with the slope of the sloping floor 312' to identify the gap distance between the ejectors and the substrate at that location. The target lines 324' identify the lines that would be printed if the gap distance remained at the distance closest to the printheads, which is the distance of the planar surface of the housing 304' from the face of the printheads in the array 104.

The device 300 is useful for identifying characteristics of the printheads for printing objects as the surface of the object slopes away from the printheads in a manner similar to the floor 312. This direction is denoted as the cross-process direction in this document as it is orthogonal to the direction of device 300 movement past the printheads in the plane of the device movement. The device 300' is useful for identifying characteristics of the printheads for printing objects as the surface of the object slopes away from the printheads in a manner similar to the floor 312'. This direction is denoted as the process direction in this document, which is the direction of device 300' movement past the printheads.

Figure 3A:
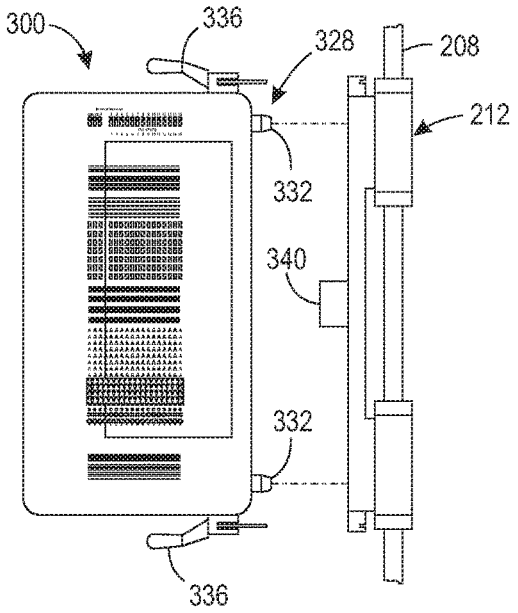
FIG. 3A to FIG. 3D depict details of the apparatus shown in FIG. 1 and FIG. 2 with the moveably mounted member shown in FIG. 5A and FIG. 5B.

Device 300 mounts to movably mounted member 212 as shown in FIG. 3A. The device 300 includes a latch 328 and locating pins 332 to aid in properly positioning the device 320 to member 212, which is supported by members 208 as shown in FIG. 4A, for latching. Once properly positioned, levers 336 operate the latch 328 to secure the device 300 to the member 212. As shown in the figure, member 212 includes an input device 340 for obtaining an identifier from the device 300 as further described below.

Figure 3B:
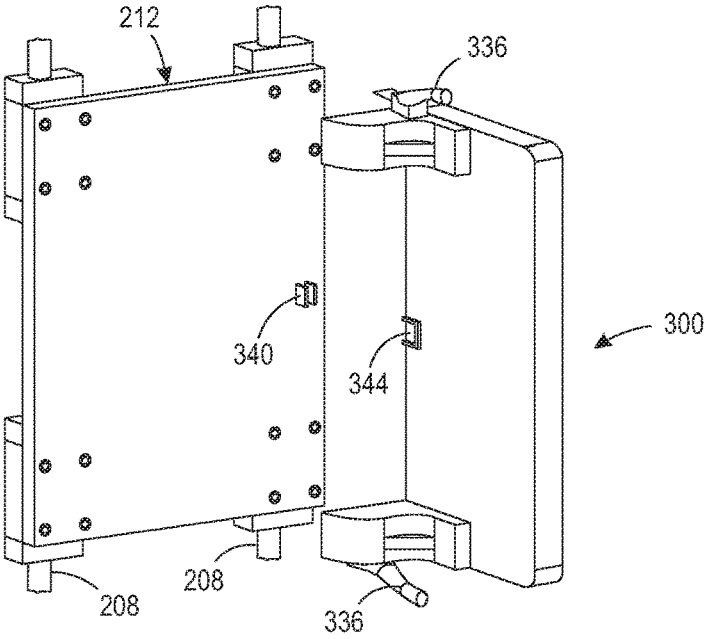

A rear perspective view of the device 300 is shown in FIG. 3B. In that figure, an identification tag 344 on a surface of the device 300 faces the input device 340 on the movably mounted member 212 when the device is secured to the member 212. The input device 340 is operatively connected to a controller 224, such as controller 224 shown in FIGS. 5A and 5B, to communicate an identifier from the identification tag 344 to the controller. The controller is further configured to operate the printhead array and actuator, such as the printhead array 204 and the actuator 216 shown in FIGS. 5A and 5B with reference to the identifier received from the input device 340 of the movably mounted member 212. As used in this document, "identification tag" means machine-readable indicia that embodies information to be processed by the printing system. The indicia can be mechanical, optical, or electromagnetic. In one embodiment, the identification tag 344 is a radio frequency identification (RFID) tag and the input device 340 of the movably mounted member is a RFID reader. In another embodiment, the identification tag 344 is a bar code and the input device 340 of the movably mounted member 212 is a bar code reader. In another embodiment in which mechanical indicia are used for the identification tag, the indicia are protrusions, indentations, or combinations of protrusions and indentations in a material that can be read by a biased arm following the surface of the identification tag. The input device 340 in such an embodiment can be a cam follower that converts the position of an arm that follows the mechanical features into electrical signals.

The controller operatively connected to the input device 340 is further configured with programmed instructions stored in a memory to compare the identifier received from the input device 340 of the movably mounted member 212 to identifiers stored in the memory operatively connected to the controller. The controller disables operation of the actuator that moves the member 212 in response to the identifier received from the input device 340 failing to correspond to one of the identifiers stored in the memory. In another embodiment, the controller is further configured with programmed instructions stored in the memory to compare the identifier received from the input device 340 of the movably mounted member 212 to identifiers stored in the memory, and the controller 224 disables operation of the printheads in the array of printheads 204 in response to the identifier failing to correspond to one of the identifiers stored in the memory. In some embodiments, the controller is configured to disable both the actuator that moves the member 212 and the array of printheads 204 in response to the identifier received from the input device 340 failing to match one of the identifiers stored in the memory.

Figure 5B:
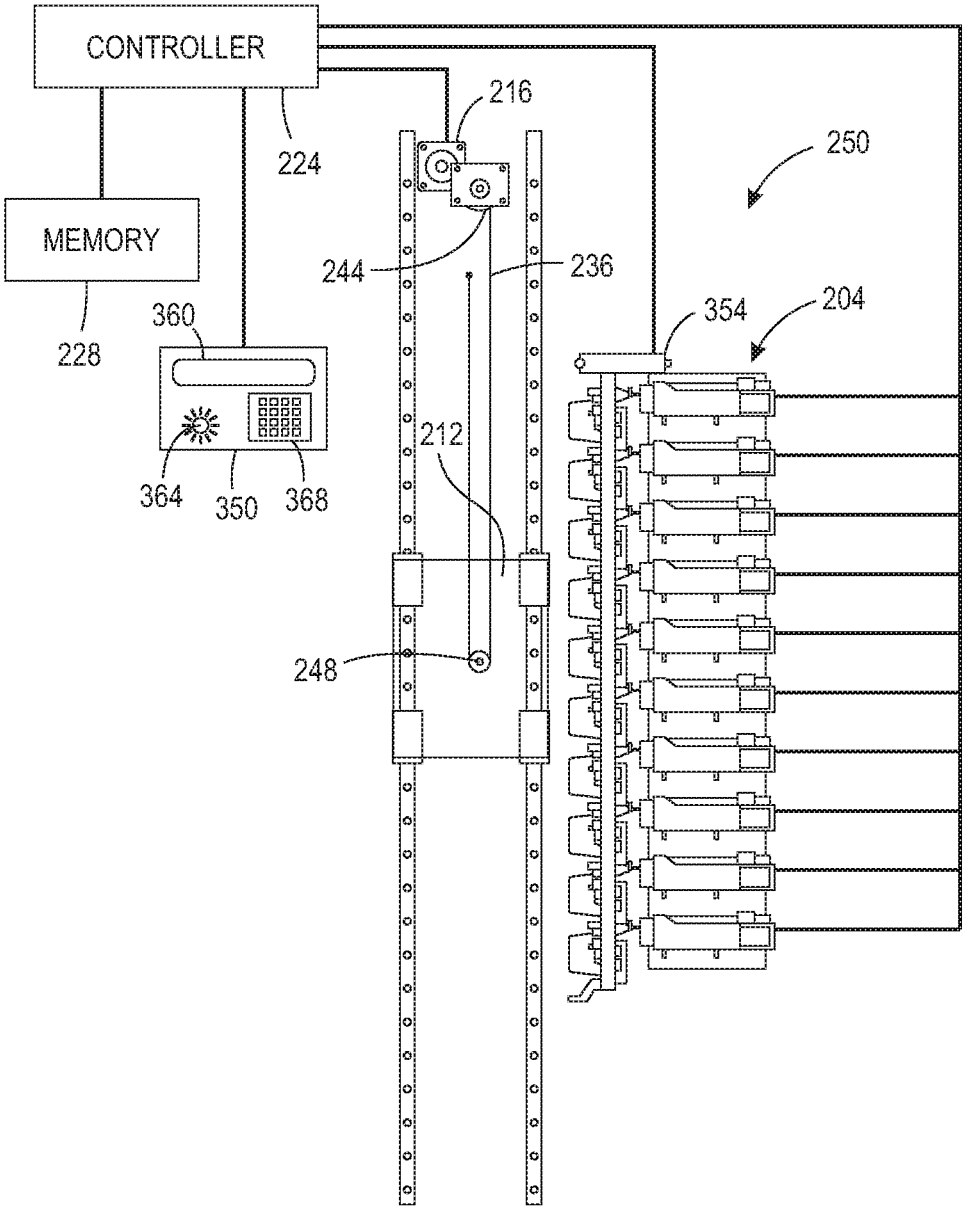
FIG. 5B PRIOR ART
Figure 5C:
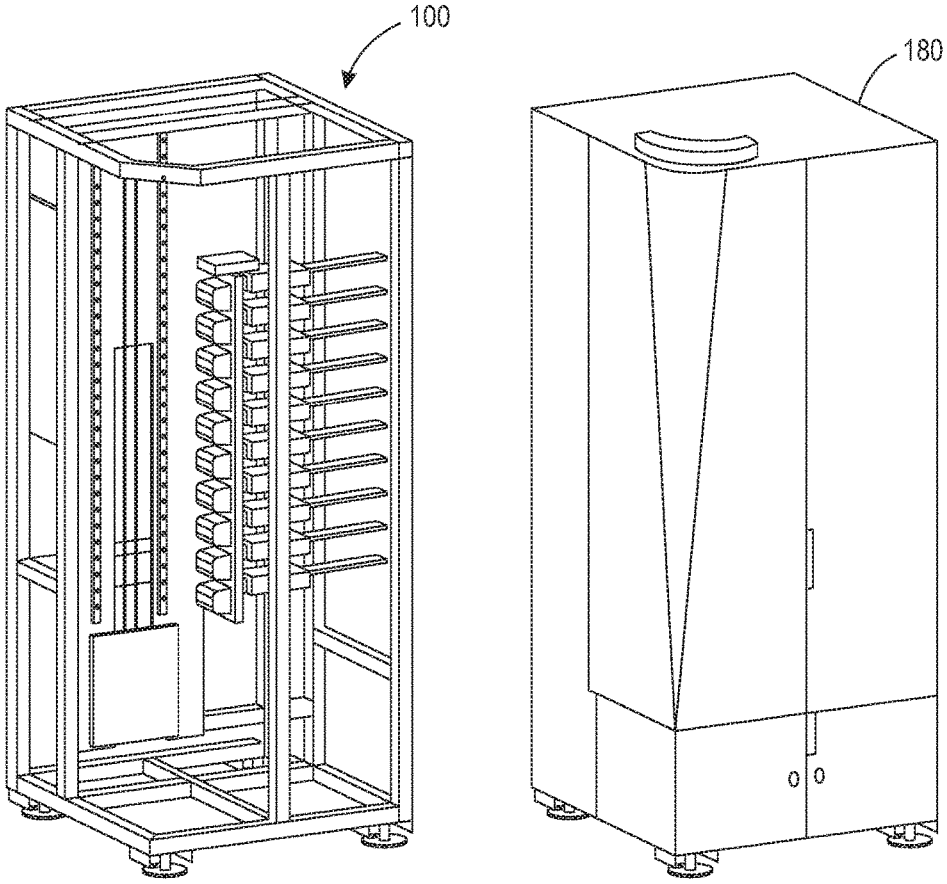
FIG. 5C PRIOR ART
FIG. 5C depicts a prior art cabinet within which one of the embodiments shown in FIG. 5A and FIG. 5B can be installed.

In all of the embodiments that are configured for use device 300 and device 300', the controller is operatively connected to a user interface, such as the user interface 350 shown in FIG. 4, FIG. 5A, and FIG. 5B. The interface 350 includes a display 360, an annunciator 364, and an input device 368, such as a keypad. The controller 224 is configured with programmed instructions to operate the user interface to notify an operator of the failure of the identifier received from the input device 326 to correspond to one of the identifiers in memory. Thus, the operator is able to understand the reason for the disabling of the system. Additionally, the controller operatively connected to the user interface is configured with programmed instructions to operate the user interface 350 to inform the operator of a system status that is incompatible with the identifier received from the input device 340. For example, the device 300' has a floor that slopes in a direction orthogonal to the direction of the floor slope in device 300. In all of the embodiments similar to those in FIG. 4, FIG. 5A, and FIG. 5B that are configured for use device 300 and device 300', the controller monitors the identifier for the different embodiments of the device 300 and 300' to determine how to operate the printheads to identify the characteristics of the printheads. If the device 300 is not the correct device for evaluating the effects of varying distance on the flight paths of drops in a predetermined direction, then the controller operates the user interface 350 to generate a message on the display 360 for the operator that the device 300 needs to be changed to the device 300' or some other embodiment discussed in this document. The user interface 350 includes a display 360 for alphanumeric messages, a keypad 368 for entry of data by an operator, and an annunciator 364, such as a warning light or audible alarm, to attract attention to displayed messages.

Figure 3C:
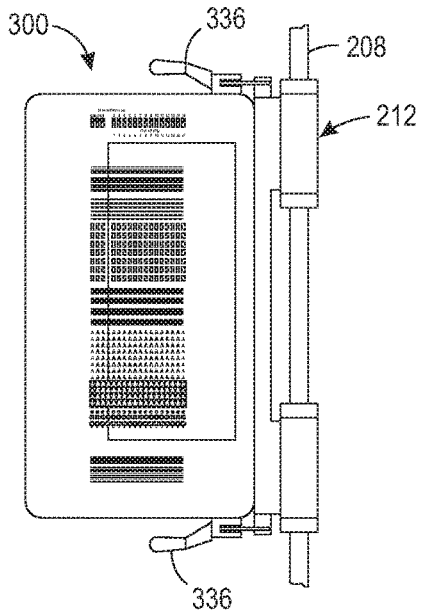
Figure 3D:
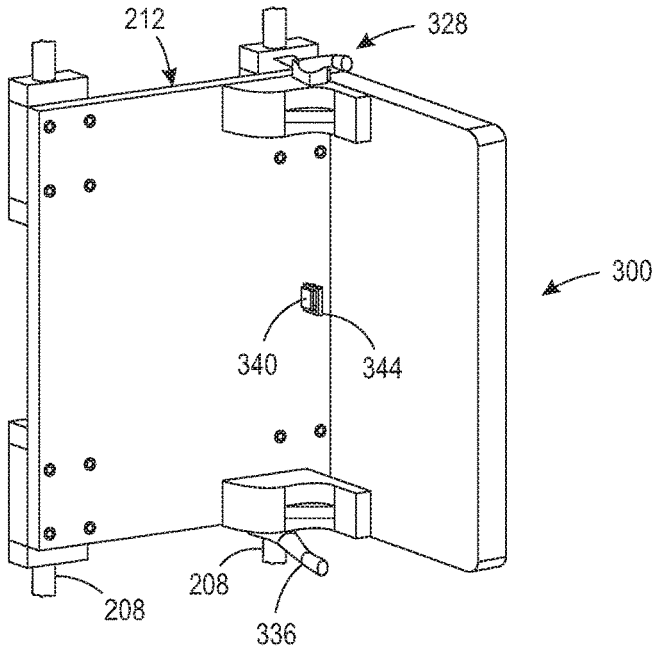

FIG. 3C shows a front view of the device 300 secured to the movably mounted member 212 and FIG. 3D shows a rear view of the device 300 secured to the moveably mounted member 212. When device 300 is mounted to the member 212, the end of the sloping floor 312 flush with the planar surface of the housing 304 passes by the printheads 104 (FIG. 4) or 204 (FIG. 5A or FIG. 5B) at a gap useful for printing flat substrates. The other end of the sloping floor 312 is at a depth of approximately 15 mm from the printheads. This depth is approximately the maximum depth at which the printheads can eject drops of marking material and maintain appropriate image quality. Other dimensions and angles of slope for the device 300 as well as different gap distances from the printheads can be used depending upon the speed of drop ejection, drop mass, and related printhead parameters.

The sloping floors 312 and 312' and their opposites enable accurate visualization of the "time-of-flight" droops in the ejected drop paths induced by the increasing gap between the ejectors and the substrate. The lines on the substrate also show how different types of ink, different ejectors within a printhead, and different printheads affect the droop in the drop paths. The different droop rates cause cola to-color mis-registrationat different gap distances. While the printed lines and fiducial marks on the substrate enable immediate intuitive human analysis, the substrates can be detached from the devices and fed through a scanner for optical imaging and computer analysis. The effects identified either by human observation or computer analysis can be used to adjust tonal reproduction curves for the DTO printer. The analysis enabled by the devices 300 and 300' and their opposites is faster, simpler, and more efficient than obtaining the printing of test patterns on multiple flat substrates and then analyzing the optical images of the multiple substrates printed at a constant gap distance.

The devices 300 and 300' and the embodiments that having sloping floors in the opposite directions help evaluate any image quality (IQ) artifact that has an angular component in either or both of the process or cross-process directions over various depths. Additionally, the longer the length of the sloping floor enables more accurate measurements to be obtained. This advantage occurs because IQ artifacts arising from angular components provide more information about the artifact as the gap distance increases so as the depth increases the artifact becomes more pronounced. Thus, the effect can be measured more easily without noise, which helps simplify the analysis of the effect for preparation of its compensation.

In operation, an operator can initiate a test or setup mode through the input device of the user interface 350 once a device 300, 300', or one of the embodiments having floors that slope in the opposite directions is installed on the member 112 or 212, and the controller obtains the data identifying the device from the identification tag on the device. In response, the controller in the printer, such as controller 224, operates an actuator, such as actuator 216, to move the identified device past the printheads as the controller operates the printheads with reference to the type of device being used to eject one or more test patterns onto the substrate on the device. As noted above, a printing system in which the devices 300, 300' and the embodiments having floors that slope in the opposite directions can be used, an optical sensor 354, such as a digital camera, can be included that is positioned to generate image data of the test pattern on the substrate after the test pattern has been printed. The controller executing programmed instructions analyzes the image data of the test pattern on the media sheet to identify the effects of depth changes on the ejectors in the printheads and develop compensation parameters for improving the alignment of drops from ejectors within printheads or from ejectors in different printheads.

While the DTO printers depicted in FIG. 4 and FIG. 5A to 5C are vertically oriented printers, the apparatus and substrate described above can also be used in horizontally oriented printers. In horizontally oriented printers, the objects move horizontally past horizontally arranged printheads. In this arrangement, the drops ejected from the printheads are affected by gravity along a vector that is perpendicular to the vector of object motion. In a more vernacular manner, the drops are pulled downwardly by gravity while the object is moving horizontally. In the vertically arranged printheads of the printer embodiments shown in FIG. 4 and FIG. 5A to 5C that can be used with the apparatus described above, gravity still pulls the drops downwardly while the object is moving in the opposite direction, that is, upwardly past the printheads. In the printers having the horizontally arranged printheads, the more effective test patterns include the dots or squares shown on the substrate 316 in FIG. 1 and FIG. 2, while the more effective test patterns in the printers having the vertically arranged printheads include the lines shown on the substrate 316 in the same figures. That is, the test patterns on the substrate 316 in FIG. 1 and FIG. 2 depict the different types of markings useful in the test patterns printed in either printer configuration.

The devices described above with slopes in the process direction and fiducial marks and target lines in the cross-process direction can be used to obtain and quantify image distortion that occurs from compression and expansion of an image arising from linear motion of an object at varying depths in the in-process direction. The devices having slopes in the process direction and the fiducial marks and target lines in the process direction are useful for calibrating printhead firing parameters for the effect of varying depth in the cross-process direction on particular printheads or ejectors. Also, devices with slopes in the process direction and fiducial marks and target lines in the cross-process direction enable drop shifts for particular printheads caused at different depths to be detected and compensation parameters identified. For example, these devices can be used to detect an effect that temperature and depth can have on the path of drops can have on some printheads used in DTO printers. Devices with slopes in either direction at various slopes can be used to quantify the effects of object slope on image quality. Devices with floors that slope in either direction and that have target lines of solid and tinted tone or color patches can be used to quantify tone and color differences at various depths. Also, devices with floors that slope in either direction and that have target lines of fine graphic and type elements can be used to quantify image quality of small features at different depths.

It will be appreciated that variations of the above-disclosed apparatus and other features, and functions, or alternatives thereof, may be desirably combined into many other different systems or applications. Although the various embodiments of the devices have been described with reference to a DTO printer, the devices can be used in any printer in which the surfaces to be printed can be placed at different depths from the printheads or in system that use ejector heads at different distances from the material receiving surface, such as a deposition surface. Various presently unforeseen or unanticipated alternatives, modifications, variations, or improvements therein may be subsequently made by those skilled in the art, which are also intended to be encompassed by the following claims.

What is claimed is:

1. An apparatus comprising:

a housing having a cavity with a sloping floor to enclose a triangular volumetric space within the cavity and the housing has a planar surface that surrounds the cavity; and a substrate attached to the planar surface adjacent the cavity and to the sloping floor within the cavity to enable a printhead that extends across a plane parallel to the planar surface of the housing in a cross-process direction to eject drops of material onto the substrate for evaluation of an effect of a changing distance between ejectors in the printhead and the substrate.

2. The apparatus of claim 1, the substrate further comprising:

fiducial marks on the substrate separated by a predetermined distance.

3. The apparatus of claim 2 wherein the fiducial marks on the substrate extend in the cross-process direction.

4. The apparatus of claim 3, the substrate further comprising:

predetermined lines of marking material on the substrate that extend in the cross-process direction on a side of the cavity that is opposite a side of the cavity on which the fiducial marks are located, the predetermined lines of marking material being configured to show deviation in a line of marking material drops ejected onto the substrate caused by the changing distance between the ejectors in the printhead and the substrate.

5. The apparatus of claim 4 wherein the sloping floor slopes in the cross-process direction.

6. The apparatus of claim 1 wherein the sloping floor slopes in the process direction.

7. The apparatus of claim 6, the substrate further comprising:

fiducial marks on the substrate separated by a predetermined distance.

8. The apparatus of claim 7, the substrate further comprising:

fiducial marks on the substrate separated by a predetermined distance.

9. The apparatus of claim 8, the substrate further comprising:

predetermined lines of marking material on the substrate that extend in the process direction on a side of the cavity that is opposite a side of the cavity on which the fiducial marks are located, the predetermined lines of marking material being configured to show deviation in a line of marking material drops ejected onto the substrate caused by the changing distance between the ejectors in the printhead and the substrate.

10. A printing system comprising:

a plurality of printheads arranged in a two-dimensional array, each printhead being configured to eject marking material;

a support member positioned to be parallel to a plane formed by the two-dimensional array of printheads;

a member movably mounted to the support member;

an actuator operatively connected to the movably mounted member to enable the actuator to move the moveably mounted member along the support member;

an apparatus configured to mount to the movably mounted member to enable the object holder to pass the array of printheads as the moveably mounted member moves along the support member, the apparatus having:

a housing having a cavity with a sloping floor to enclose a triangular volumetric space within the cavity and the housing has a planar surface that surrounds the cavity; and a substrate attached to the planar surface adjacent the cavity and to the sloping floor within the cavity to enable a printhead that extends across a plane parallel to the planar surface of the housing in a cross-process direction to eject drops of material onto the substrate for evaluation of an effect of a changing distance between ejectors in the printhead and the substrate; and a controller operatively connected to the plurality of printheads and the actuator, the controller being configured to operate the actuator to move the apparatus past the array of printheads and to operate the plurality of printheads to eject marking material onto the apparatus as the apparatus passes the array of printheads.

11. The printing system of claim 10, the substrate of the apparatus further comprising:

fiducial marks on the substrate separated by a predetermined distance.

12. The printing system of claim 11 wherein the fiducial marks on the substrate extend in the cross-process direction.

13. The printing system of claim 12, the substrate of the apparatus further comprising:

predetermined lines of marking material on the substrate that extend in the cross-process direction on a side of the cavity that is opposite a side of the cavity on which the fiducial marks are located, the predetermined lines of marking material being configured to show deviation in a line of marking material drops ejected onto the substrate caused by the changing distance between the ejectors in the printhead and the substrate.

14. The printing system of claim 13 wherein the sloping floor slopes in the cross-process direction.

15. The printing system of claim 10 wherein the sloping floor slopes in the process direction.

16. The printing system of claim 15, the substrate further comprising:

fiducial marks on the substrate separated by a predetermined distance.

17. The printing system of claim 16, the substrate further comprising:

fiducial marks on the substrate separated by a predetermined distance.

18. The printing system of claim 17, the substrate further comprising:

predetermined lines of marking material on the substrate that extend in the process direction on a side of the cavity that is opposite a side of the cavity on which the fiducial marks are located, the predetermined lines of marking material being configured to show deviation in a line of marking material drops ejected onto the substrate caused by the changing distance between the ejectors in the printhead and the substrate.

* * * * *